United States Patent [19]

Biebuyck

[11] Patent Number: 4,982,531

[45] Date of Patent: Jan. 8, 1991

[54] METHOD EMPLOYING ABRASIVE TOOLS FOR THE COMBINED CUTTING AND TRIMMING OF GLASS OR CRYSTAL ARTICLES AND AN APPARATUS FOR CARRYING OUT THE SAID METHOD

[75] Inventor: Leon Biebuyck, Obourg, Belgium

[73] Assignee: Etablissements Biebuyck S.A., Houdeng-Goegnies, Belgium

[21] Appl. No.: 356,744

[22] Filed: May 24, 1989

[30] Foreign Application Priority Data

May 26, 1988 [BE] Belgium ..... 08800583

[51] Int. Cl.[5] ..... B24B 9/12

[52] U.S. Cl. ..... 51/283 E; 51/5 C; 51/42; 51/118; 51/326

[58] Field of Search ..... 51/283 E, 283 R, 5 B, 51/5 C, 227 R, 42, 118, 326

[56] References Cited

U.S. PATENT DOCUMENTS

| | | | |
|---|---|---|---|
| 117,208 | 7/1871 | Richardson | 51/227 R |
| 4,185,419 | 1/1980 | Ilk | 51/283 E |
| 4,852,304 | 8/1989 | Honda et al. | 51/5 C |
| 4,872,290 | 10/1989 | Jenkinson et al. | 51/283 R |

FOREIGN PATENT DOCUMENTS

| | | | |
|---|---|---|---|
| 0592576 | 2/1978 | U.S.S.R. | 51/227 R |

*Primary Examiner*—Robert A. Rose
*Attorney, Agent, or Firm*—Herbert Dubno

[57] ABSTRACT

The method employing abrasive tools for the combined cutting and trimming of glass or crystal articles is carried out while the article (47) is maintained substantially vertical and while the moil (48) constitutes the bottom part of the glass or crystal mass constituting the article (47) to be machined. During cutting, two abrasive discs (10) substantially simultaneously penetrate the article (47) which is to be cut, at substantially opposite locations and in accordance with a substantially opposing directions of approach. Mounted on the same arbor (13) are a cutting disc (10) and a finishing grinder (11) so that the cutting and finishing or trimming operations are performed at the same work station. Mechanisms comprising the elements (37, 39, 40, 21, 25, 26, 27, 28, 29, 33, 34, 35, 36) permit of rapid and easily modulable adaptation of the apparatus between the cutting and finishing operations. A finishing or trimming operation is performed by using the upper surface (44) of the abrasive part (43) of the cutting disc (10). The trimming or finishing operation may be carried out by controlled application of the grinder (11) to the article (47) or by controlled displacement of the grinder (11) in relation to the article (47).

4 Claims, 3 Drawing Sheets

METHOD EMPLOYING ABRASIVE TOOLS FOR THE COMBINED CUTTING AND TRIMMING OF GLASS OR CRYSTAL ARTICLES AND AN APPARATUS FOR CARRYING OUT THE SAID METHOD

FIELD OF THE INVENTION

The invention relates to a method employing abrasive tools for the combined cutting and trimming of glass or crystal articles and also to an apparatus for carrying out the method.

BACKGROUND OF THE INVENTION

The use of abrasive tools for cutting glass or crystal articles is generally designed to detach from the actual article the mass of glass or crystal, hereinafter referred to as the moil, which was used for holding the article while it was being shaped by plastic deformation while hot.

The use of abrasive tools for trimming glass or crystal ware is the operation which follows the cutting stage and is generally intended to finish the edge left on the article by the cutting operation.

Conventionally, the abrasive tool cutting of glass or crystal articles is performed by means cf an abrasive disc, the axis of rotation of which is situated in a substantially vertical plane, the article being so positioned that the anticipated cutting plane coincides with the plane of symmetry of the abrasive disc. Generally, the article is set on its base on a substantially horizontal plane, the upper part of the mass of glass or crystal constituting the article to be cut constituting the part hereinabove defined as being the moil or cullet, the bottom part of the glass or crystal mass constituting the article to be cut actually representing the article proper.

Cutting glass or crystal articles with abrasive tools is likewise conventionally performed by means of an abrasive disc, the axis of rotation of which is situated in a substantially horizontal plane, the article being so positioned that the anticipated cutting plane coincides with the plane of symmetry of the abrasive disc. Generally, the article is held by a device in such a way that its base is situated in a substantially vertical plane.

Cutting glass or crystal articles with abrasive tools is likewise conventionally performed by means of two abrasive discs working substantially at the same time and penetrating the article to be cut according to identical movements. In this case, the axis of rotation of the abrasive discs is generally in a substantially vertical plane and the article is generally set on its base on a substantially horizontal plane, the upper part of the mass of glass or crystal constituting the article to be cut constituting the part which is hereinabove defined as being the moil, the lower part of the mass of glass or crystal constituting the article to be cut representing the article proper.

Whichever is the geometrical configuration chosen, the sequence of operations is identical. Firstly, the disc or discs, rotating at high speed, will slowly approach the article which is stationary and will penetrate the article to a suitable depth, that is to say if the article is solid then it will penetrate sufficiently close to the center or if the article is hollow then it will penetrate it sufficiently that the edge of the abrasive disc will break through into the central cavity, when penetration is considered as complete. Secondly, the article is caused to rotate slowly so that during the course of this rotation the abrasive disc cuts a furrow into the mass of glass or crystal, which finally results in the moil becoming detached from the useful part of the article. The slow rotation of the article may already have begun while the abrasive disc is still in the process of penetrating the article.

When only one disc being used, the path followed by the disc during penetration into the article may be substantially radial, which, for a given article, corresponds to the least displacement of the abrasive disc; on the other hand, if a single disc is performing the cutting operation, the article will be required to make a rotation of about 360° in order to be cut through completely.

According to the conventional method of cutting, using an abrasive disc having an axis of rotation which is substantially vertical, the moil is above the cutting disc during the cutting process, which makes it necessary to hold it manually or to use some device to support the moil and keep it in place during and above all towards the end of the cutting process. If this is not done or is only improperly done, then the weight of the moil will bear on the section of glass or crystal still connecting it to the useful part of the article during cutting, stressing this section and imparting a flexion strain on it which may result in sudden and premature detachment of the moil by a fragile breaking of the glass or crystal section still connecting it to the useful part of the article. Such a break may form a considerably jagged edge or, more generally cause a mechanical deterioration of the edge or bottom of the article produced by the cutting disc; the moil which is detached from the useful part of the article may result in damage to the cutting discs and/or it may be thrown by the discs in an uncontrolled way which could be hazardous for the operator. Similarly, according to this method, the mixture consisting of the cutting liquid charged with powdered glass or crystal will be splashed over the useful part of the article. Furthermore, if the article is hollow and has a fluidtight bottom part, the powder-laden cutting liquid will accumulate in the cavity, perhaps even completely filling it, after which it is necessary either to empty the article before removing it from the machine or to remove it from the machine still filled with cutting liquid. Whatever shape the article is, it is necessary carefully to clean the surface to remove any powdered glass which remains clinging to it. Generally, this cleaning operation is quite time-consuming; it is tiresome to perform the job manually but it is not simple to automate the process, by reason of the wide variety of shapes of such articles.

According to the conventional method of cutting, using an abrasive disc having a substantially horizontal axis of rotation, the weight of the moil which is not supported or is inadequately supported during cutting will bear on the section of glass or crystal which is still connecting the moil to the useful part of the article, stressing it with a composite flexion and shearing stress. This stress, as in the preceding case, may produce sudden and premature detachment of the moil by fragile breakage of the glass or crystal section still connecting it to the useful part of the article. As in the previous case, this break may produce a considerably jagged edge or, more generally, mechanical damage to the edge or bottom of the article produced by the cutting disc; the moil which has just become detached from the useful part of the article may also cause damage to the cutting discs.

If two discs are used, each disc penetrating the article with identical movements, their path during penetration can only be substantially tangential, which in the majority of cases will substantially increase the movement to be performed in order for penetration to be complete. Once penetration is completed, by reason of the penetration of the two discs in accordance with identical movements, the two sections of glass or crystal connecting the moil to the useful part of the article and situated on either side of the furrows caused by the two abrasive discs as they penetrate the article are not identical; that situated in the direction of the original position of the cutting discs prior to penetration will generally be smaller than that which is situated in the opposite direction; therefore, there must be some equalizing phase prior to carrying out the actual cutting process; for this, the article is caused to rotate in the direction opposite to that used for cutting until such time as one of the two discs has, via the groove which it produces during rotation, caused one of the two straight edges of the groove produced during penetration of the two cutting discs, to disappear. Once this operation has been performed, the actual cutting can be carried out fairly rapidly due to the presence of two simultaneously working discs. In this case, the moil which becomes detached from the useful part of the article rests on the two cutting discs; it may result in damage to the cutting discs and/or it may be thrown off by them in an uncontrolled fashion which may be hazardous for the operator.

The trimming or finishing of the edge or bottom of glass or crystal articles is conventionally performed by an abrasive cup wheel of which the axis of rotation is perpendicular or substantially perpendicular to the plane of the edge or of the bottom of the article produced by cutting. As the article is rotating slowly, the grinder is applied to the bottom or edge of the article with a controlled effort; if the grinder has to machine a bottom completely, its abrasive edge will necessarily pass through the centre of rotation of the article; if a more or less thick wall of a hollow article has to be machined, the grinder will be so positioned that its edge is secant to this wall at two quite different places and if possible at two substantially opposite locations.

Maching of the glass or crystal by the cup wheel is carried out at a constant force until such time as the grinder which is penetrating the material comes to bear on a mechanical abutment which is regulated in such a way as to remove an optimum thickness of material.

Generally, the cutting and finishing operations are carried out at different work stations or on different machines.

A machine is already known which employs a cutting device comprising a frame consisting of a base and two columns connected by a cross-member adapted for displacement along the columns and carrying the article carrying head provided with a gripping means, likewise connected by a cross-member generally fixed and equipped with a device for supporting and positioning the tool carrying units. This is the DIAVER type machine built by Messrs. DIAMANT BOART s.a., Avenue du Pont de Luttre 74, B-1190 Forest. This machine carries out the single operation of cutting and employs two discs having substantially vertical axes of rotation, penetrating the article to be cut along identical paths; the article is set on its base on a substantially horizontal table, the part which is hereinabove referred to as the moil constituting the upper part of the mass of glass or crystal constituting the article to be cut.

Also known is a machine which employs cutting and finishing means comprising a frame consisting of a base and two columns connected by a cross-member adapted for displacement along the columns and carrying the article carrying head provided with a gripping means, likewise connected by a cross-member generally fixed and equipped with a device for supporting and positioning the tool carrying units, as well as means for carrying out other associated finishing operations, which is the type 505 machine built by Messrs. W. LINDNER MASCHINEN GmbH, Altenstein 12, D-8352 Grafenau. In the case of the type 505 LINDNER machine, the cutting and finishing operations and the other associated finishing process are performed consecutively at different work stations, each operation being carried out at a single station. Indexing is performed by rotation of the substantially horizontal circular work table on which a plurality of loading stations are provided at equal angular intervals. The article, loaded on its base, is substantially vertical, the part referred to hereinabove as the moil constituting the upper part of the glass or crystal mass which constitutes the article to be cut; the axes of the cutting disc and of the grinders are likewise substantially vertical. The different operations are performed on successive work stations, only the work station on which the operation occupying the most time is performed being permanently in use.

OBJECT OF THE INVENTION

The object of the present invention is to remedy these disadvantages. The invention as characterised in the claims consists of using abrasive tools in a method for the combined cutting and finishing of glass or crystal articles, and also an apparatus for carrying out the method, characterised in that the article is supported by a device in such a way that its axis is substantially vertical, the lower part of the glass or crystal mass constituting the article to be cut constituting what has been defined hereinabove as the moil, while the upper part of the mass of glass or crystal constituting the article to be cut and constituting the actual article, in that two abrasive discs having substantially vertical axes penetrate the article to be cut at substantially opposite locations and in accordance with substantially opposite directions of approach, and in that each of the two tool-carrying arbors on which a respective cutting disc is mounted likewise carries a finishing grinder so that the two operations performed consecutively by these two tools can be performed on one and the same work station, and in that a finishing operation is carried out after the cutting, by a lateral face of the abrasive part of the cutting disc, and in that the finishing operation is carried out under the stress of the tool bearing on the article or by the tool being displaced in relation to the article.

The advantages obtained by reason of this invention substantially reside in that the moil is situated below the cutting disc, its weight stressing the two equivalent sections of glass or crystal still connecting the moil to the useful part of the article only in a traction sense; it follows that this moil becomes detached in a balanced way from the useful part of the article and falls by gravity with no risk of damaging either the edge of the article produced by the cutting nor the abrasive disc which is used. The cutting fluid, charged with glass or crystal powder, cannot splash onto the actual article. Each of the two tool-carrying arbors carries at the same time a cutting disc and a finishing grinder and/or a finishing operation is performed by one of the lateral surfaces of the abrasive part of the cutting disc, the cutting and finishing operations possibly being performed on the same work station, which maximizes the rate of use of this station.

BRIEF DESCRIPTION OF THE DRAWING

The invention is explained in greater detail hereinafter with reference to an embodiment of the invention which is shown in the accompanying drawing, in which.

SPECIFIC DESCRIPTION

Figure 1:
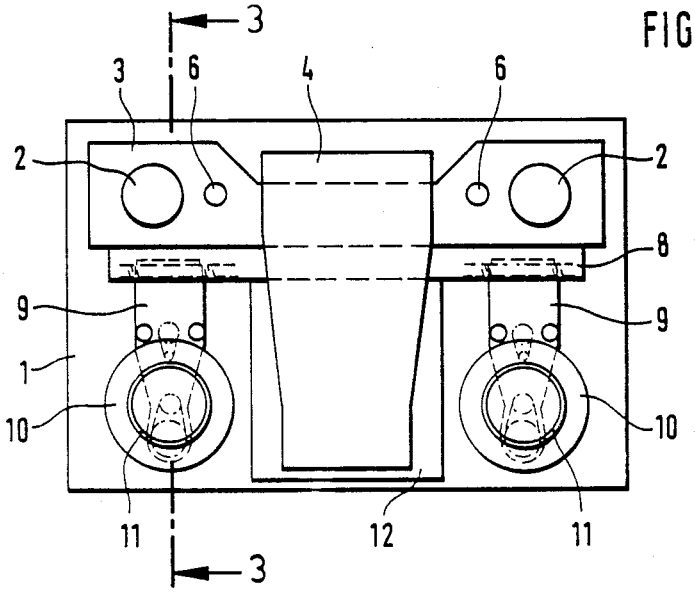
FIG. 1 is a plan view of an apparatus for carrying out the combined cutting-finishing operation according to the present invention.
Figure 2:
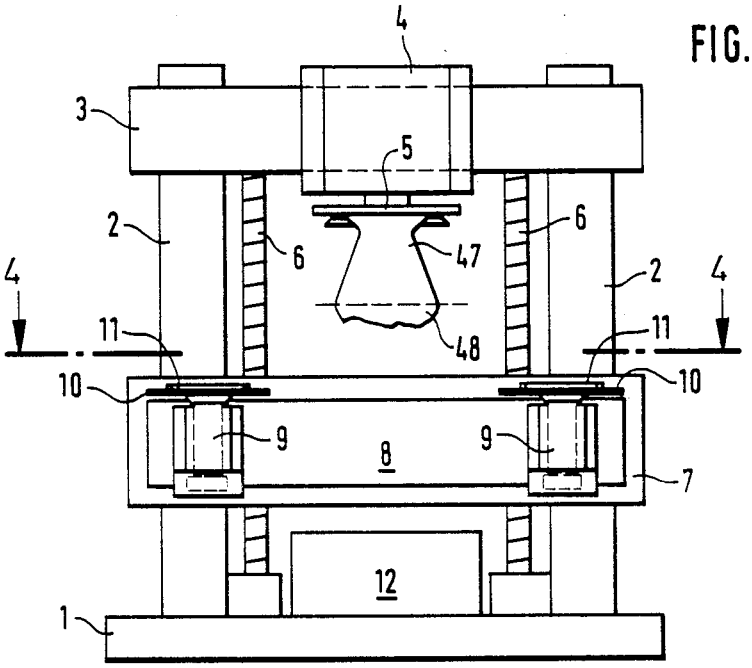
FIG. 2 is an elevation of an apparatus for carrying out the combined cutting-finishing operation according to the present invention.
Figure 3:
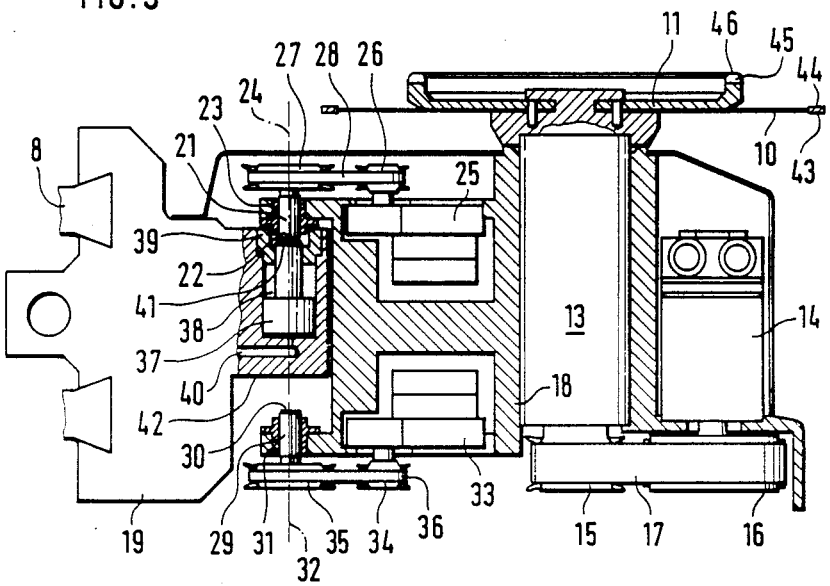
FIG. 3 is a section taken on a line 3—3 as shown in FIG. 1 of a possible embodiment of tool carrier according to the present invention.
Figure 4:
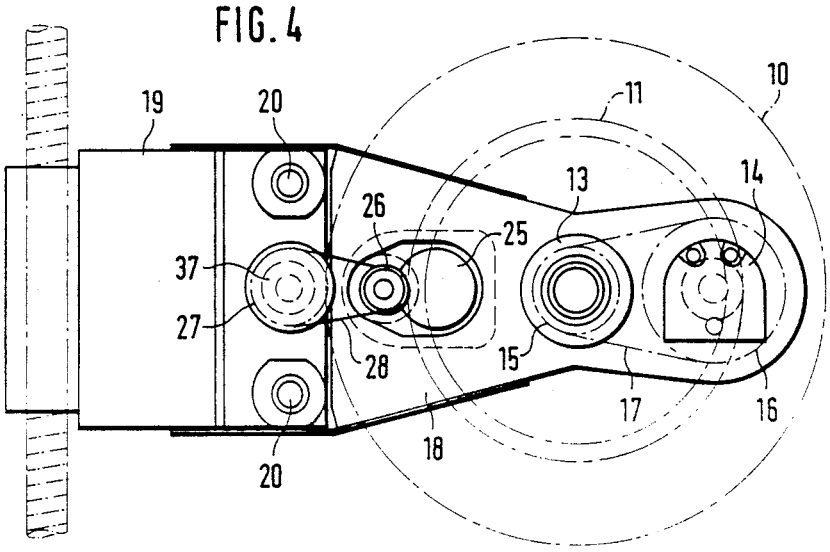
FIG. 4 is a section taken on the line 4—4 in FIG. 2 of a possible embodiment of a tool carrier according to the present invention.

The drawing shows an apparatus for carrying out the combined cutting-finishing operation according to the present invention and essentially comprising a frame consisting of a base 1 and two uprights 2 which are connected at the top by a cross-member 3; fixed on the cross-member 3 is the article-carrying head 4 provided with a gripping means 5 for so supporting the article 47 which is to be machined that the moil 48 constitutes the lower part of the article to be machined; the cross-member 3 may be displaced along uprights 2; the position of the cross-member 3 in relation to the uprights 2 is established by a positioning device 6. The two columns 2 are likewise connected at their bottom by a cross-member 7 which is generally fixed; the cross-member 7 is equipped with means 8 for supporting and positioning the tool carrier units 9. Each tool carrier unit 9 is fitted with a cutting disc 10 and a finishing grinder 11. The base 1 carries means 12 for collecting and carrying away moils 48.

A tool carrier unit 9 essentially comprises a tool carrier arbor 13 which is rotated by a motor 14 through pulleys 15 and 16 and a belt 17; the arbor 13 and the motor 14 are fixed on a structural member 18; the structural member 18 is connected to another structural member 19 by means of columns 20 and vis-a-vis this structural member 19, it does have a degree of freedom of movement according to these columns 20. The structural member 19 is fixed to the supporting and positioning means 8.

The relative extreme positions of the structural member 18 in respect of the structural member 19 are determined by a double system of adjustable stops: a member 21 comprising a bearing surface 22 is connected to the structural member 18 through a thin connecting member 23; rotation of this member 21 in respect of the structural member 18 produces a displacement of the member 21 in relation to the structural member 18 and according to the axis 24; this rotation is printed and controlled by a micromotor 25 through pulleys 26 and 27 and a belt 28; similarly, a member 29 comprising a bearing surface 30 is connected to the structural member 18 through a thin connecting member 31; rotation of this member 29 in relation to the structural member 18 causes a displacement of the member 29 in relation to the structural member 18 according to the axis 32; this rotation is printed and monitored by a micromotor 33 through pulleys 34 and 35 and a belt 36. Generally, the micromotors 25 and 33 are controlled by a logic or data unit.

A piston 37 slides in a housing 38 provided in the structural member 19; its maximum travel is determined by the position of the underside of the stop member 39. Left to itself, the piston 37 occupies the low position; it is pushed into the high position by a pressurized fluid supplied via the duct 40 at the level of the underside of the piston 37.

In accordance with this configuration, the surface 22 of the member 21 is always in contact with the upper surface 41 of the piston 37, the piston 37 assuming the low position if the duct 40 is no longer being supplied with pressurized fluid or is in the high position if the duct 40 is being supplied with pressurised fluid. The functional stroke of the piston, of which the maximum stroke is determined by the height of the cylindrical chamber left free in the housing 38, is determined by the existing distance, when the piston is in the low position, between the bearing surface 30 of the member 29 and the underside 42 of the structural member 19. As this distance may vary by the displacement on the axis 32 of the member 29 produced and controlled by rotation of the micromotor 33, the functional stroke of the piston 37 can therefore be regulated. Similarly, displacement of the member 21 in relation to the structural member 18 being produced and controlled by the rotation of the micromotor 25, the position of the structural member 18 in relation to the structural member 19 when the piston 37 is in the low position, that is to say in fact the position of the plane of symmetry of the cutting disc 10 in relation to the supporting and positioning means 8 is likewise regulable.

Generally, the article-carrier head 4 is so designed that the clamp 5 carrying the article 47 may be caused to perform a controlled rotation in terms of its angular position, speed of rotation and angular acceleration, via a logic or data unit. The positioning device 6 which controls displacement of the upper cross-member 3 along the columns 2 is generally controlled by a logic or data unit. Likewise, the displacements of the two tool-carrier units 9 along the supporting and positioning device 8 are generally independent of each other and are controlled by a logic or data unit so that these displacements can be synchronised with the rotation of the clamp 5 carrying the article 47 and the displacement of the cross-member 3 so that articles of complex or irregular form can be machined under the best possible conditions. The speed of rotation of the tools 10 and 11 is likewise regulable.

The article 47 is loaded on the article carrying head 4 manually or by an automated device, the moil 48 constituting the bottom part of the glass or crystal mass constituting the article to be machined. The tools 10 and 11 are set in rotary motion. The cutting operation is carried out firstly by the two abrasive discs 10 working substantially simultaneously. At this moment, the piston 37 is maintained in the high position by the pressurized fluid supplied via the duct 40; prior to this, the two cutting discs 10 are brought into the same substantially horizontal plane by adjustment of the bearing surfaces 30. The two cutting discs 10 penetrate the article to be cut at substantially opposite locations and in accordance with substantially opposing directions of approach, and substantially simultaneously, by displacements parallel with themselves in their common substantially horizontal plane which is at right-angles to the axis 24, represented in effect by the displacements of the tool carriers 9 along the supporting and positioning means 8. At one precise moment during penetration or once penetration is completed, the article 47 is caused to rotate slowly. The grooves produced by the discs 10 during the course of rotation of the article 47 lead to detachment of the moll 48 after a rotation which is less than or equal to 180°.

Once cutting is completed, the moil 48 falls by gravity into the moil collecting and removing apparatus 12. At this moment, it is possible optionally to perform a first finishing operation, the finishing tool being the upper surface 44 of the diamond-surfaced part 43 of the cutting disc 10. The cutting discs 10 are brought into a position which is favourable for this finishing operation by a displacement, parallel with themselves, in their common substantially horizontal plane at right-angles to the axis 24, represented by the displacements of the tool carriers 9 along the supporting and positioning means 8. The relative positions of the two cutting discs 10 in relation to the article 47 on the axis 24 being substantially identical, an identical penetration of the upper lateral face 44 of these two discs 10 is determined by an equivalent displacement of the cross-member 3 on the columns 2, this displacement being controlled precisely by the positioning device 8.

Once the operation of using the lateral face 44 of the cutting disc 10 to finish off the edge is completed, it is possible to start a finishing operation using the finishing grinder 11. The duct 40 is no longer being supplied with medium and the piston 22 falls back to the low position: it follows that the abrasive tools 10 and 11 move along the axis of the columns 20 substantially vertically by a distance equal to the distance between the bearing surface 30 and the underside 42 of the structural member 19 when the piston 37 is in the low position. This distance has been regulated beforehand and for each tool carrier unit by the position of the bearing surface 22, in view of the fact that the position of the bearing surface 30, being slightly greater than the distance, projected on the axis 24, between the upper surface 44 of the abrasive part 43 of the cutting disc 10 and the upper surface 46 of the abrasive part 45 of the finishing grinder 11 so that it is possible, without risk of interference to the article 47 which has just been cut, for the finishing grinder 11 to be moved into place under this article, in a favourable position for the finishing process. The values of this distance will not generally be exactly identical for both tool carrier units; they may be substantially different if the abrasive tools and in particular the finishing grinders 11 are of different types or are worn to different extents. If the distance, projected on the axis 24, between the upper surface 44 of the abrasive part 43 of the cutting disc 10 and the upper surface 46 of the abrasive part 45 of the finishing grinder 11 is substantially identical for both tool carrier units 9, the relative displacement of the article 47 in respect of the tools 10 and 11 between the cutting and finishing operations may be obtained by an equivalent-distance displacement of the cross-member 3 along the columns 2, the axes of which are substantially parallel with the axis 24, controlled by the positioning means 8.

Once the grinder or grinders has or have been brought into the finishing position under the article 47, the finishing operation may commence; it may be carried out by only one of the two grinders 11; in this case, the two grinders 11 may be of equal quality and may be used alternately; the two grinders 11 may likewise be different and may be used successively on one and the same article. The smoothing operation may likewise be carried out by the two grinders 11 working substantially simultaneously; in this case, the two grinders 11 are generally of equal quality.

When the trimming or finishing operation is being performed, the progressive penetration of the grinders 11 may be precisely monitored by the displacement of the cross-member 3 along the columns 2. It is likewise possible to allow the penetration to occur freely as removal of the material constituting the article by the abrasive grinder proceeds; in this case, it is the force applied by the grinder to the article which is controlled by the pressure of fluid applied to the underside of the piston 31, the abutment 30 coming in contact with the underside 42 of the structural member 19 to limit penetration of the grinder into the article. The distance of penetration of the abrasive grinder 11 during finishing being generally different from the distance between the upper surface 44 of the abrasive part 43 of the cutting disc 10 and the upper face 46 of the abrasive part 45 of the finishing grinder 11, adjustment of the stop 30 will, by this method of working, have to be altered twice during each combined cutting-finishing cycle. According to this method of working and only if the distance, projected on the axis 24, between the upper surface 44 of the abrasive part 43 of the cutting disc 10 and the upper surface 46 of the abrasive part 45 of the finishing grinder 11 is substantially identical for both tool carrying units, then the distance between the bearing surface 30 and the underside 42 of the structural member 19, the piston 37 being in the low position, can be maintained equal to the distance of penetration of the grinder 11 into the article 47 during the finishing operation, an additional and sufficient displacement of the cross-member 3 along the columns 2 between the cutting and smoothing operations making it possible without risk of interference to bring the grinder 11 into the smoothing or finishing position under the article 47.

Figure 5:
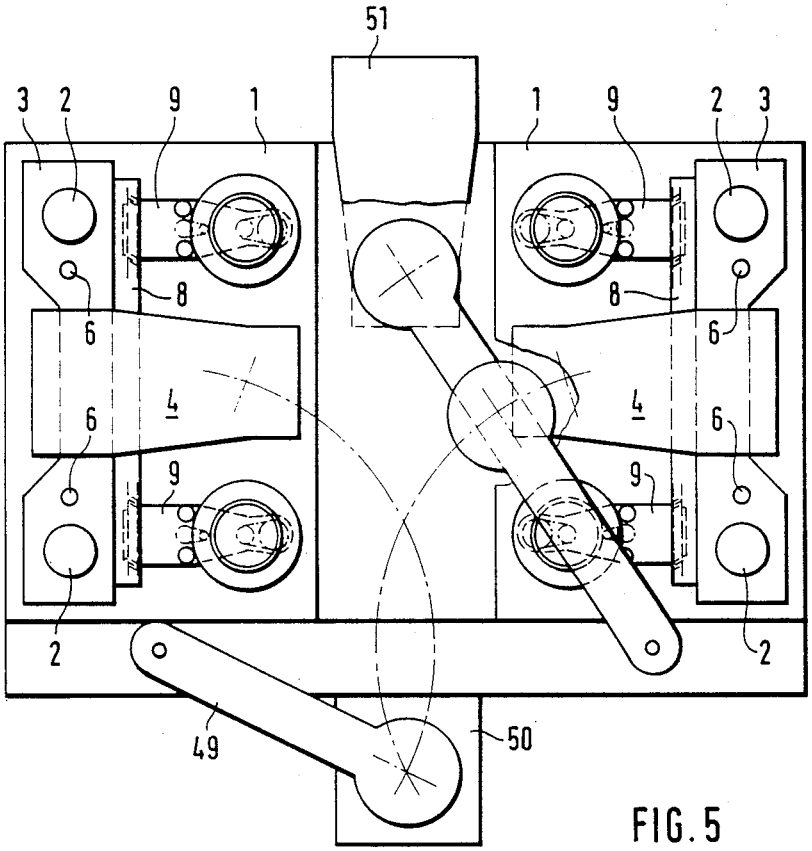
FIG. 5 shows in plan view an advantageous combination of two combined cutting-finishing apparatuses, constituting one machine for carrying out the combined cutting-finishing operation, and also another associated finishing operation.

A machine for carrying out the combined cutting-finishing operation and an additional finishing process is advantageously constituted by a combination of two combined cutting-finishing devices shown in FIG. 5 and identified by reference numerals 1, 2, 3, 4, 5, 7, 8 and 9 placed face to face, each constituting a principal work station operating simultaneously in accordance with staggered cycles, the loading of which is carried out alternately and automatically by two arms 49 which are themselves manually or automatically supplied from one loading station 50. The loading arms comprise a telescopic extension device so that the article 47 which has just been discharged from one of the cutting-finishing devices may be presented to a work station 51 where an ancillary finishing operation is performed.

I claim:

1. A method of cutting a moil from a glass article having a first axis and trimming a cut portion of the article from which the moil has been cut, comprising the steps of:

(a) holding said article with said first axis disposed vertically and said moil disposed at a bottom of the article;

(b) displacing respective abrasive moil-cutoff disks rotating about respective second and third vertical axes horizontally into said article from opposite sides and in opposite directions and rotating said article about said first axis to cut off said moil and produce a cut edge on said article adjacent a cut portion thereof while maintaining said disks in respective upper limiting positions along the the respective second and third vertical axes, each of said disks having a respective abrasive finishing wheel formed along an upper surface thereof and rotatable with the respective disk;

(c) lowering said disks to respective lower limiting positions along the respective second and third vertical axes, thereby juxtaposing said finishing wheels with said article; and (d) displacing said wheels against said article while rotating said wheels about the second and third axes of said disks and rotating said article about said first axis to trim said cut portion of said article.

2. The method defined in claim 1, further comprising finishing said cut edge with an abrasive upper surface of at least one of said disks.

3. An apparatus for cutting a moil from a glass particle having a first axis and trimming a cut portion of the article from which the moil has been cut, comprising:

a frame having a base, two columns extending upwardly from said base, a first cross member bridging said columns and displaceable vertically along said columns, means for vertically displacing said first cross member along said columns, and a second cross member bridging between said columns below said first cross member and generally fixed to said columns;

an article-carrying head on said first cross member provided with a gripping means for engaging an upper portion of a glass article having said first axis with said first axis disposed vertically and said moil disposed at a bottom of said article;

means for rotating said gripping means to rotate said article about said first axis;

two tool-carrying units disposed opposite one another on opposite sides of said article on said second cross member and having respective second and third vertical axes;

a respective abrasive disk on each of said tool-carrying units rotatable about the respective vertical axis for penetrating substantially simultaneously into said article at substantially opposite locations and displaceable in substantially opposite directions for cutting off said moil upon said rotation of said article about said first axis to produce a cut edge on said article adjacent a cut portion thereof;

means for axially shifting said cutting disks on said tool-carrying units into respective upper limiting positions in which said moil is cut off from said article, each of said tool-carrying units being formed with a finishing grinder wheel rotatable with the respective disk about the respective vertical axis; and means for lowering said disks and said wheels to lower limiting positions thereby juxtaposing said wheels with said article, said wheels being displaceable against said article while said wheels are rotated about said second and third axes and said article is rotated about said first axis to trim said cutting portion of said article.

4. The apparatus defined in claim 3 wherein said tool-carrying units each have a respective tool-carrying arbor rotatable about a respective one of said second and third axis, carrying the respective disk and carrying the respective wheel;

a piston for displacing said arbor between said positions; and stop means defining said upper and lower limiting positions.

* * * * *